US005918391A

United States Patent [19]

Viñas Peya

[11] Patent Number: 5,918,391

[45] Date of Patent: Jul. 6, 1999

[54] COUPLING JOINT FOR THE TEETH OF EXCAVATING MACHINES

[75] Inventor: Juan Viñas Peya, Madrid, Spain

[73] Assignee: Metalogenia, S.A., Barcelona, Spain

[21] Appl. No.: 08/878,992

[22] Filed: Jun. 19, 1997

[30] Foreign Application Priority Data

Jul. 1, 1996 [EP] European Pat. Off. ..... 96500090

[51] Int. Cl.[6] ..... F02F 9/28

[52] U.S. Cl. ..... 37/452; 37/456

[58] Field of Search ..... 37/450, 452, 453, 37/454, 455, 456, 457, 458, 459, 460, 451

[56] References Cited

U.S. PATENT DOCUMENTS

| | | | |
|---|---|---|---|
| 1,330,143 | 2/1920 | Seal | 37/455 |
| 2,251,169 | 7/1941 | Seal . | |
| 2,256,488 | 9/1941 | Murtaugh | 37/455 |
| 2,674,816 | 4/1954 | Daniels et al. | 37/458 |
| 2,689,419 | 9/1954 | Daniels et al. | 37/456 |
| 3,623,247 | 11/1971 | Stepe | 37/455 |
| 3,740,876 | 6/1973 | Solokhin et al. . | |
| 4,716,668 | 1/1988 | Hahn | 37/458 |
| 5,144,762 | 9/1992 | Robinson | 37/453 X |
| 5,423,138 | 6/1995 | Livesay et al. | 37/455 X |
| 5,502,905 | 4/1996 | Cornelius et al. | 37/454 X |

FOREIGN PATENT DOCUMENTS

WO 94/28257 12/1994 WIPO ..... E21F 1/00

*Primary Examiner*—Heather Shackelford
*Attorney, Agent, or Firm*—Darby & Darby

[57] ABSTRACT

The coupling joint has on the mating contact surfaces between the tooth and the tooth holder the following characteristics: the upper and lower surfaces which define the stabilisation planes comprise a substantially flat central surface and another two flat surfaces, one on each side of the said central surface, so that the interstice between the central flat surface and the corresponding facing surface of the tooth holder is smaller than the respective interstices between the lateral flat surfaces and the corresponding facing surfaces of the receiving cavity of the tooth; the upper and lower rear edges of the lugs of the tooth have a convex transverse structure; the internal vertical rear edge of the rear lugs of the tooth have surfaces of a shape matching the opposed faces of the tooth holder, giving rise to higher bearing surfaces in the case of transverse bearing on the tooth.

7 Claims, 9 Drawing Sheets

COUPLING JOINT FOR THE TEETH OF EXCAVATING MACHINES

The present invention relates to a coupling joint for the teeth of excavating machines, which has notable characteristics of novelty and inventive activity.

The new coupling joint for the teeth of excavating machines is the result of investigations carried out by the Applicant in order to solve some of the technical problems which occur at present with said elements.

As is known, teeth for excavators are used on different types of machines which correspond to this general classification, being intended to excavate earth during work connected to civil engineering works, such as public road works and the like, trenches for pipes and conduits and many others.

The hard work to which the teeth of the excavating machines are exposed represents the occurrence of multiple stresses on the latter due to the forces exerted on the actual tooth in various directions or axes, corresponding to the working axes of the tooth on the earth to be excavated, there being also added a considerable amount of wear created by the friction of the tooth in the soil and by the friction of the tooth with the tooth holder, given the inevitable existence of internal play between the parts, which increases with use.

In particular, the vertical stresses exerted on the tooth are transmitted to the adapter or tooth holder by means of the flat front surface or stabilization surface and the surface of the lateral fixing lugs, so that if these surfaces are not perfectly horizontal, but are wedgeshaped, they give rise to forces with horizontal components on the surfaces of the tooth, which tend to pull the latter out, and also result in considerable stresses on the pin, which has the task of maintaining the tooth in the mounted position.

This problem is aggravated by the progressive deformation of the surfaces of the tooth and of the tooth holder which are in contact, owing to the permanent deformation by compression and to the wear by erosion between the parts in contact, with the natural influence of abrasive materials provided by the soils being excavated.

In the same way, the occurrence of lateral stresses in the tooth results in a slight displacement in transverse rotation of the latter, it being necessary to resist the stresses through the zone of contact of the rear edge of the lugs with the bearing surface. In the teeth known at present, it gives rise to high local pressures, which increase the wear considerably.

The investigations carried out by the Applicant were intended to solve the problems mentioned above, a tooth for excavators having been obtained in which a significant technical improvement has been achieved with respect to that known at present.

In order to attain its objectives, the present invention is based on the provision of a coupling for the teeth of excavators which provides for the mating zones for coupling between the tooth and the tooth holder to comply with the following characteristics:

- the upper and lower surfaces of the coupling zone are constituted on the basis of a central zone and two lateral zones, one on each side of the said central zone, so that the play between the tooth and the tooth holder is less in the central zone than in the said lateral zones,
- the upper and lower zones or edges of coincidence between the lateral flanks of the tooth and the receiving zones of the tooth holder have a convex transverse structure fitting together with an equivalent structure of the facing wall of the tooth holder, for example, with an arched profile, preferably half tubular in shape,

- the zones corresponding to the vertical rear edges of the flanks of the teeth have a mating chamfered structure of the zone of the corresponding recess of the tooth holder receiving the said flanks, so that in the case of lateral stresses, the said edge zone bears on the surface of the chamfer, of considerable size, reducing the unit pressure and therefore the wear.

For a better understanding, drawings are provided, corresponding to an explanatory but non-limitative example, showing the prior art and showing an embodiment of the present invention.

Figure 12:
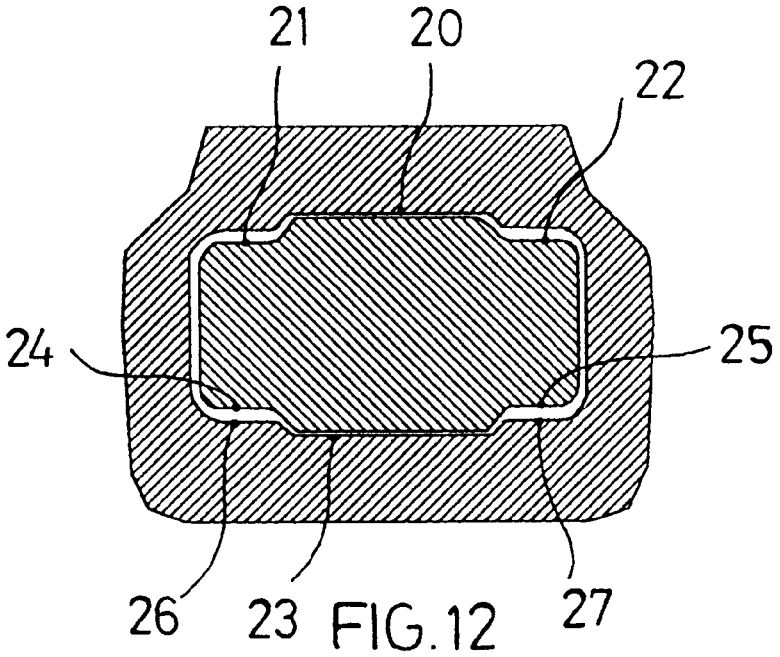
Figure 13:
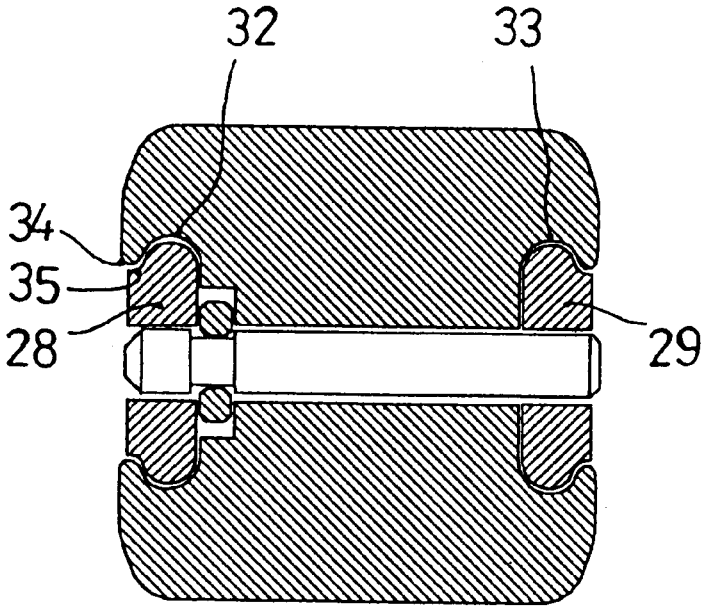

FIGS. 12 and 13 both show transverse sections, in the planes indicated, through a tooth coupling according to the present invention.

Figure 14:
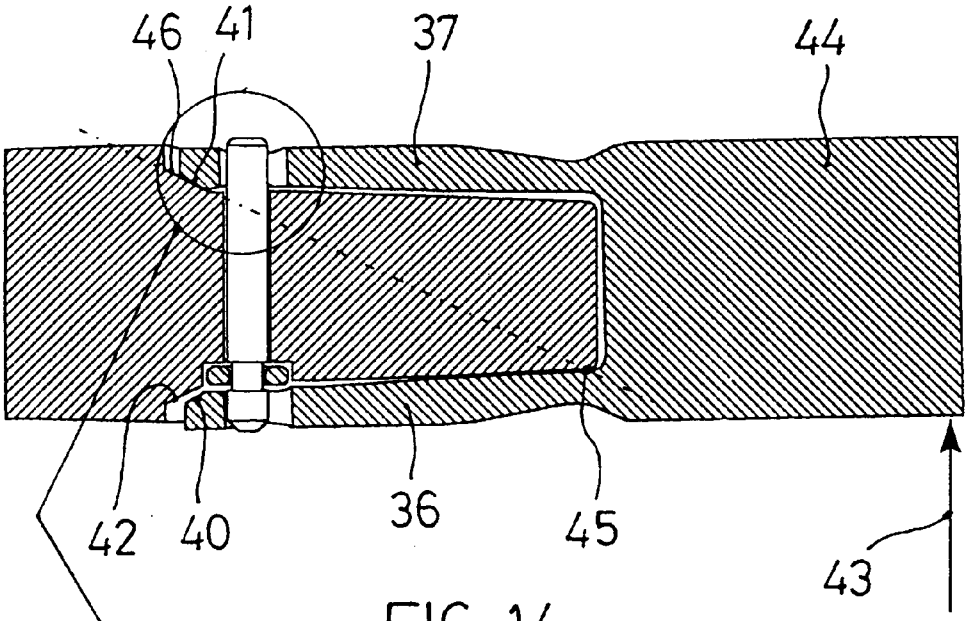

FIG. 14 shows a section in a median plane showing the coupling between the tooth and the tooth holder.

Figure 15:
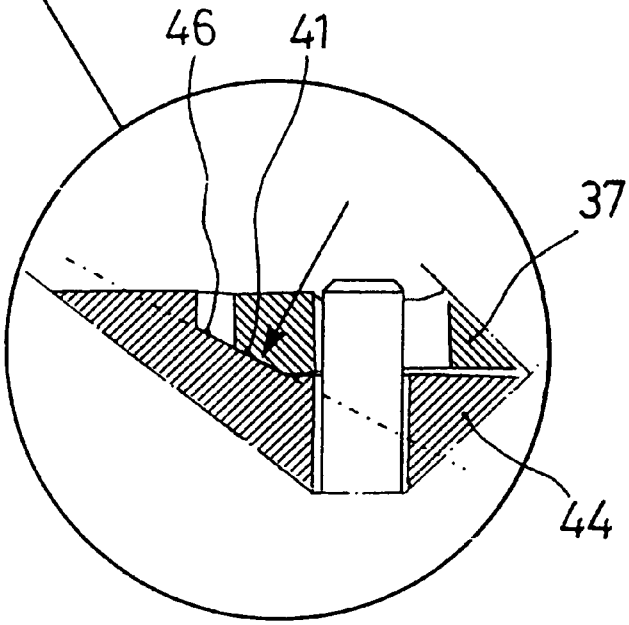

FIG. 15 shows a detail in section of Figure

Figure 16:
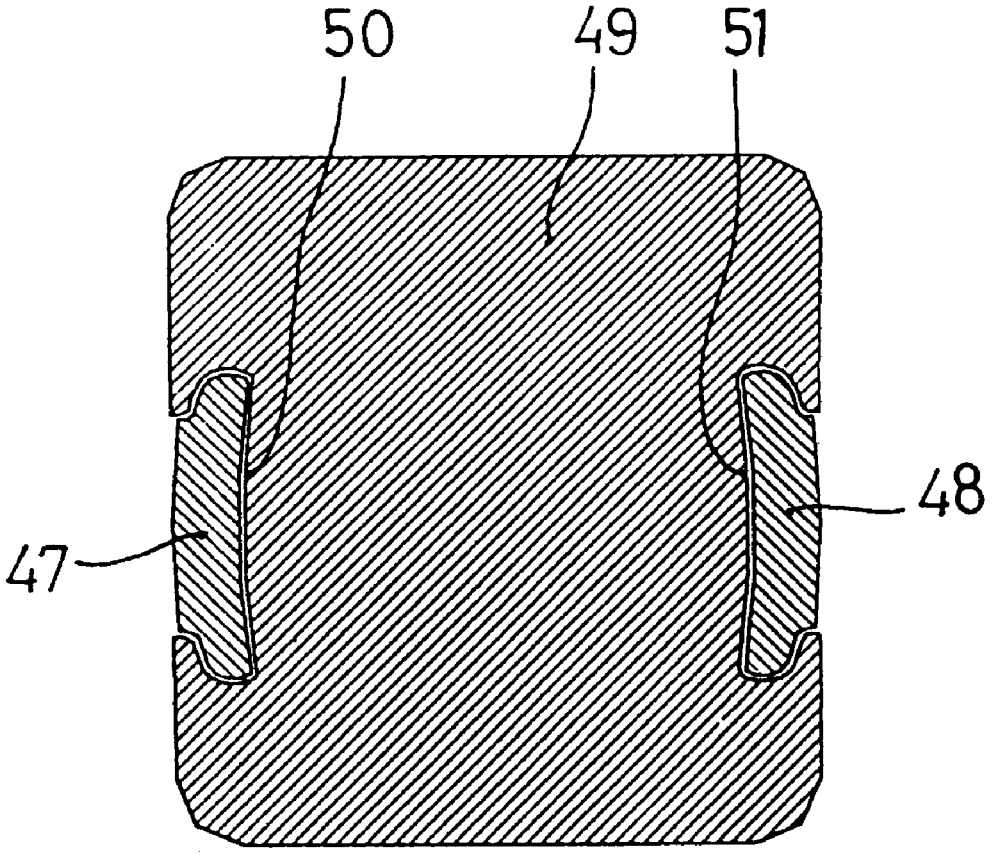

FIG. 16 shows a detail in section of an alternative embodiment.

A tooth coupling of conventional type, as illustrated in FIGS. 1 to 4, comprises schematically a tooth 1 and a tooth holder 2, so that the tooth 1 has an internal cavity in which the projecting portion 3 of the tooth holder fits in a substantially mating shape. In its rear portion the tooth 1 has lateral lugs, of which the lug 4 is shown, corresponding to one of the sides, which is introduced into a lateral seating 5 of the tooth holder 2. Rather smooth holes, 6, of the flanks of the tooth 1 permit the introduction of the fixing pin 7. When the tooth is subjected to a vertical force 8, the latter is transmitted to the tooth holder or adapter 2 by means of the flat front surface or stabilization plane 9 of the tooth and the mating surface 10 of the lug. Constructionally, the said surfaces form a certain angle with the horizontal which, owing to the horizontal components of the forces generated, results in stresses which tend to expel the tooth from the tooth holder.

Figure 1:
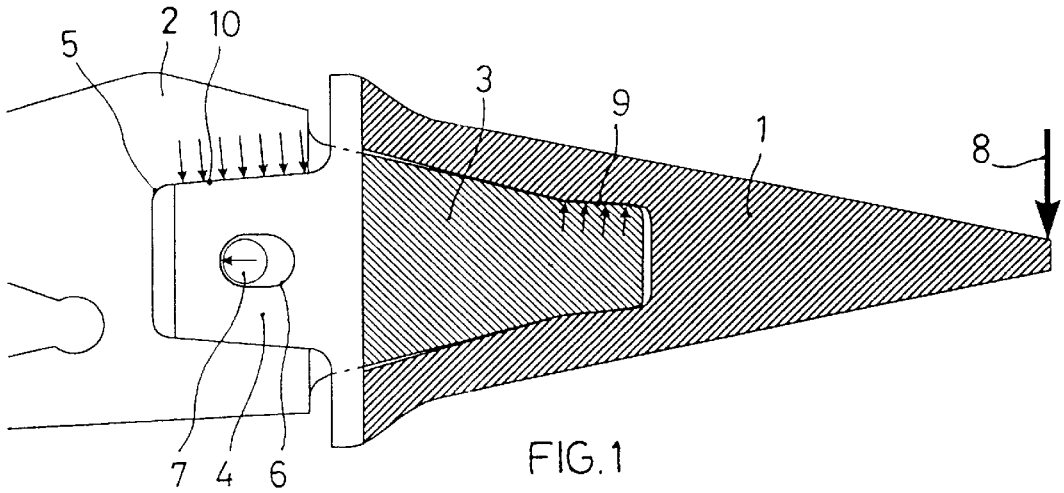
FIGS. 1 and 2 are longitudinal sections which show a coupling joint of a type known at present, in order to explain some of the problems which occur when using the latter.
Figure 2:
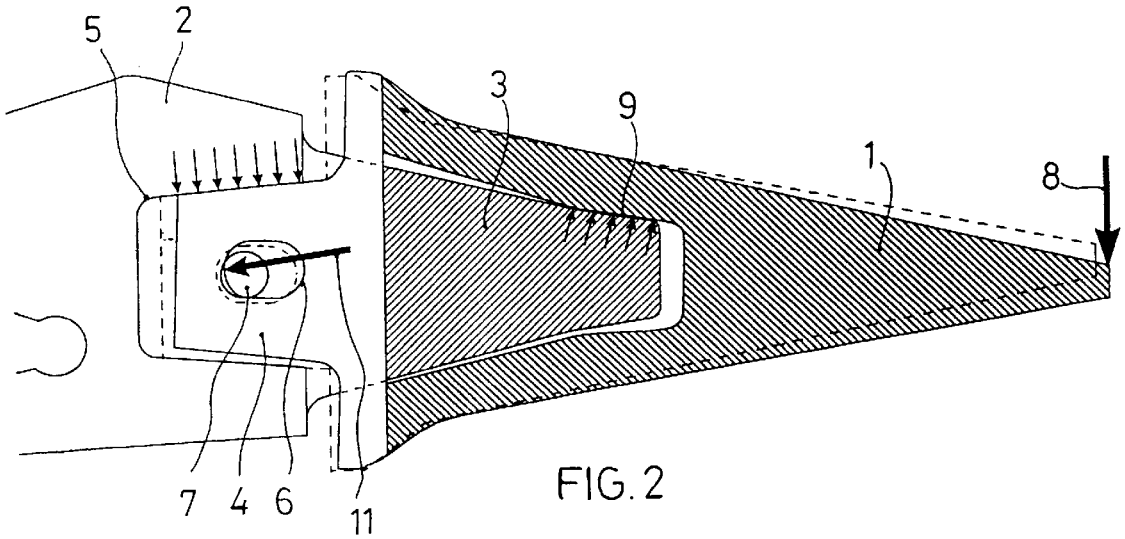

This effect is revealed more clearly in FIG. 2, in which it can be seen that after a certain wear on the front portion of the coupling projection 3, where the stabilization planes are found which interact with the lugs when the vertical force 8 is exerted on the point of the tooth, the horizontal force components increase, being represented by the vector 11, which acts on the pin, which vector is much greater than the corresponding vector which is shown in FIG. 1. This stress can bend the pin, which makes it difficult to extract the latter when the tooth has to be replaced because of wear. Fractures may also be produced in the tooth or in the pin.

Figure 3:
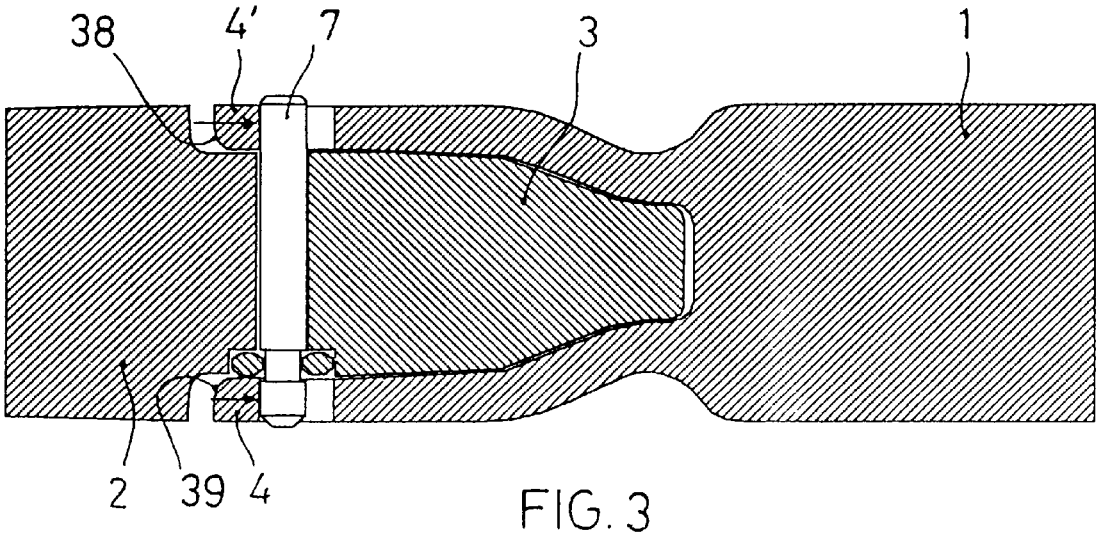
FIG. 3 is a plan view of the actual coupling joint of FIGS. 1 and 2.

In FIG. 3, which shows a diagrammatic section in plan view, there is likewise revealed the action of the lugs 4 and 4' on the pin 7 in the situations corresponding to FIGS. 1 and 2 described above.

Figure 4:
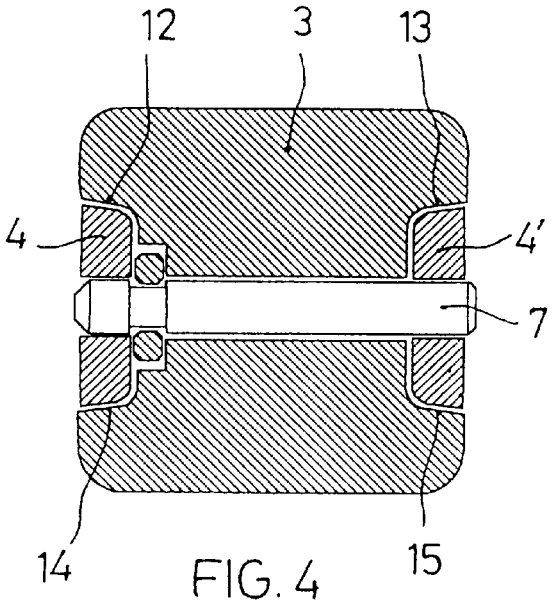
FIG. 4 shows the said coupling in transverse section, through the joint pin.

Apart from the drawbacks described above, displacement of the lugs towards the outside is also produced, as can be seen in detail in FIG. 4. In the said figure can be seen the core 3 of the tooth holder and the lateral lugs 4 and 4', it being appreciated that, when a certain inclination towards the outside is exhibited by the upper surfaces 12 and 13, and also 14 and 15 corresponding to the lower part of the seating of the lugs, the vertical stress exerted on the tooth is translated into stresses with a horizontal component towards the outside on the lugs 4 and 4', which tends to open them. This effect is more marked in wet clay soils.

FIGS. 5 to 11 show different views of a joint for coupling teeth for excavators according to the present invention, which provides a solution to the problems mentioned above.

Figure 8:
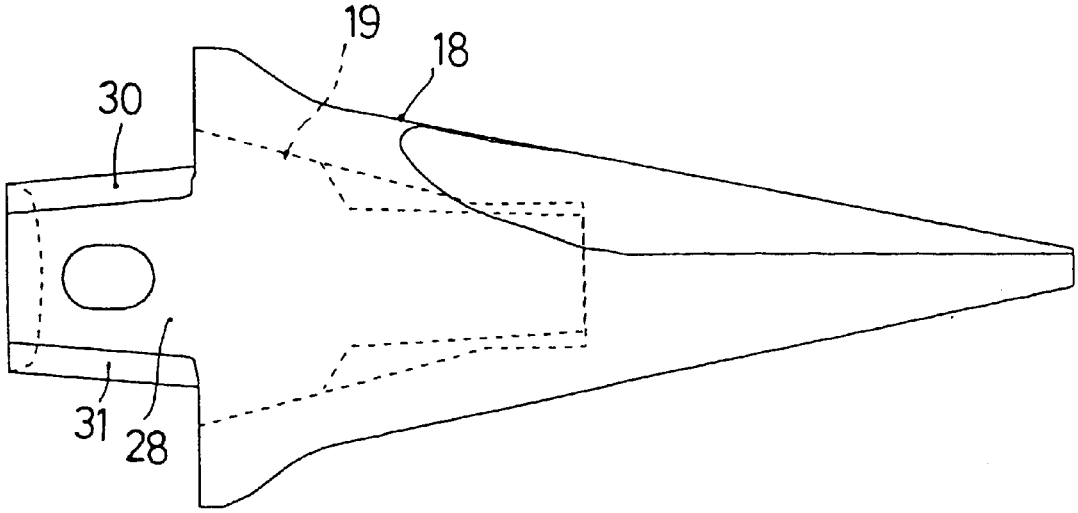
FIGS. 8 and 9 are, respectively, a view in side elevation and a plan view of the tooth of the coupling of the present invention.
Figure 9:
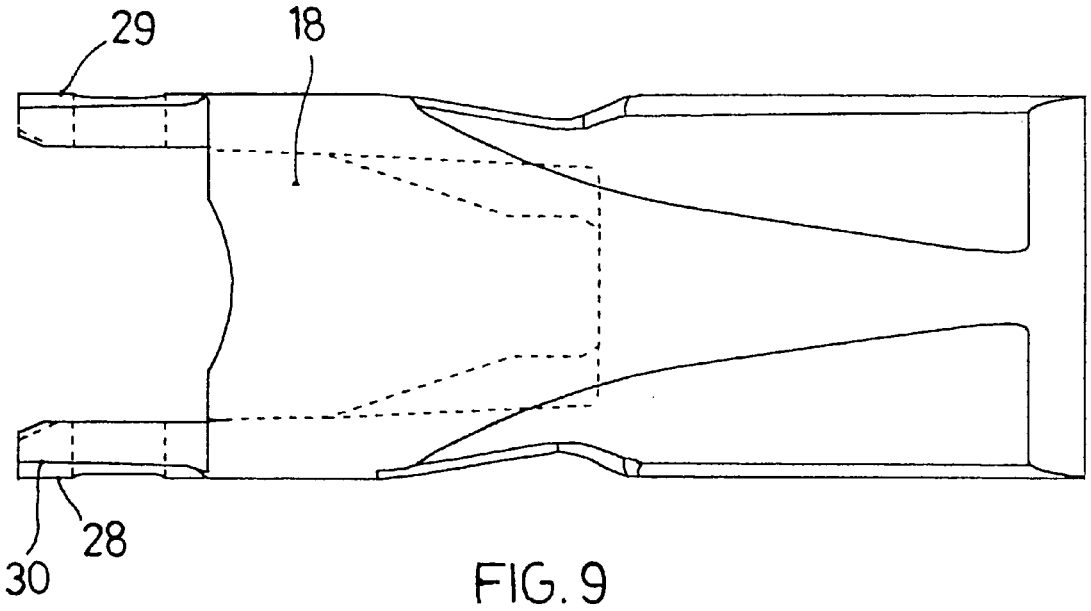
Figure 10:
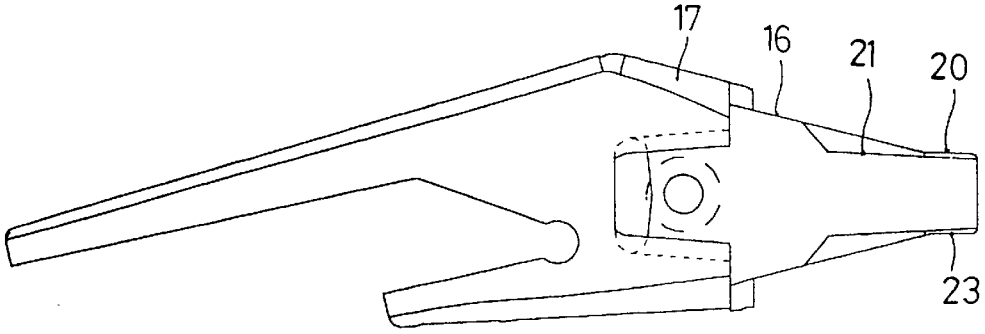
FIGS. 10 and 11 show a view in side elevation and a plan view of the tooth holder of the coupling according to the present invention.
Figure 11:
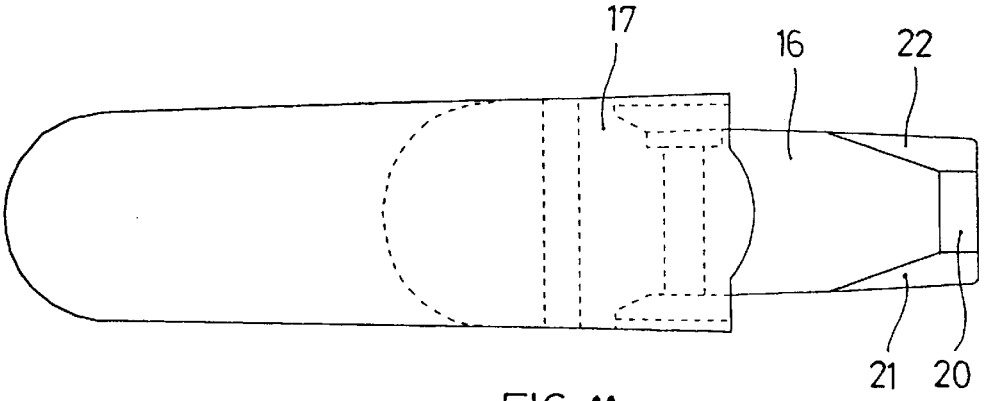

As can be seen in the said figures, in accordance with the present invention, the upper and lower surfaces of the mating portion between the tooth holder and the tooth, which surfaces are integrated in the projecting portion 16 of the tooth holder 17, which will remain inserted in the corresponding inlet of the tooth 18, as shown by the number 19 in FIG. 8, are constituted by means of a central surface 20 and both lateral surfaces 21 and 22, which has likewise been shown in detail in the sectional view of FIG. 12, there being shown in the latter not only the upper central portion 20 and the corresponding lateral portions 21 and 22, but also the corresponding central portion 23 and lateral portions 24 and 25 of the lower part. One of the characteristics of the invention consists in that the play between the central portions 20 and 23 with the respective facing zones of the tooth is less than the play existing between the lateral zones 21 and 22, or 24 and 25, and the opposed surfaces of the actual tooth, of which the lower surfaces have respectively been numbered 26 and 27.

With the arrangement shown, once the central surface has worn or is deformed, the result obtained is that the lateral surfaces, that is to say, the surfaces 21 and 22, make contact with the corresponding surfaces of the tooth, and also the surfaces 24 and 25 with those which correspond to them in the tooth, which are indicated by the numbers 26 and 27. In this situation, when the tooth is exchanged, the existence of the contact will be observed, which will indicate that the degree of wear of the coupling is already very high and that a careful evaluation must be made, possibly proceeding with the exchange of the tooth holder, in order to avoid damage in service arising from fracture of pins, as a result of the excessive wear.

Figure 5:
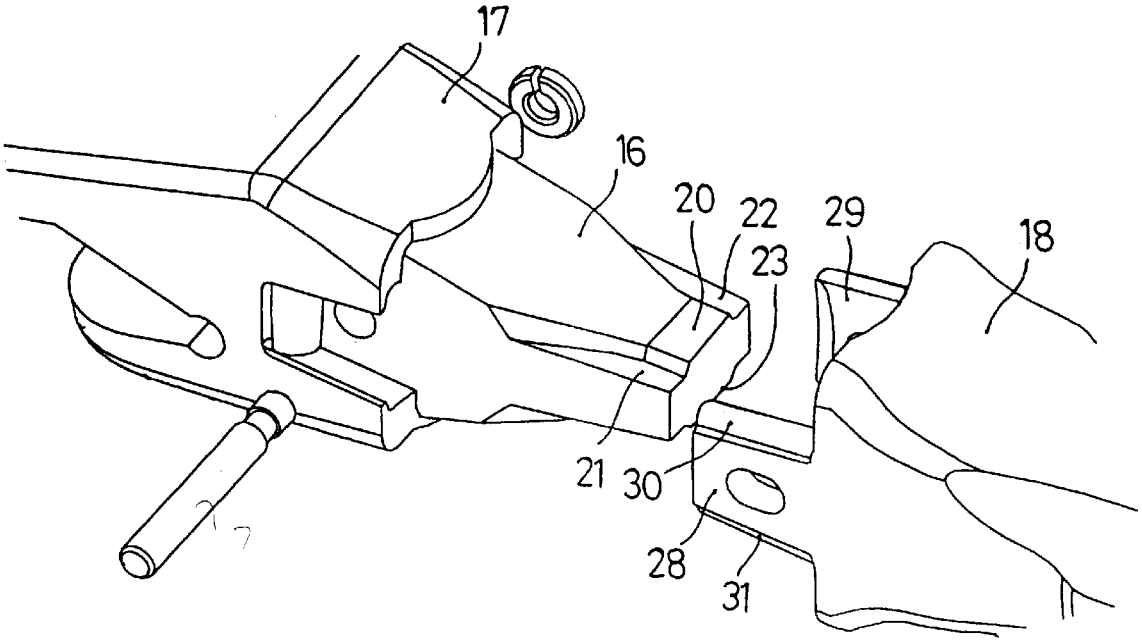
FIG. 5 shows the two principal parts of a coupling produced according to the present invention.
Figure 6:
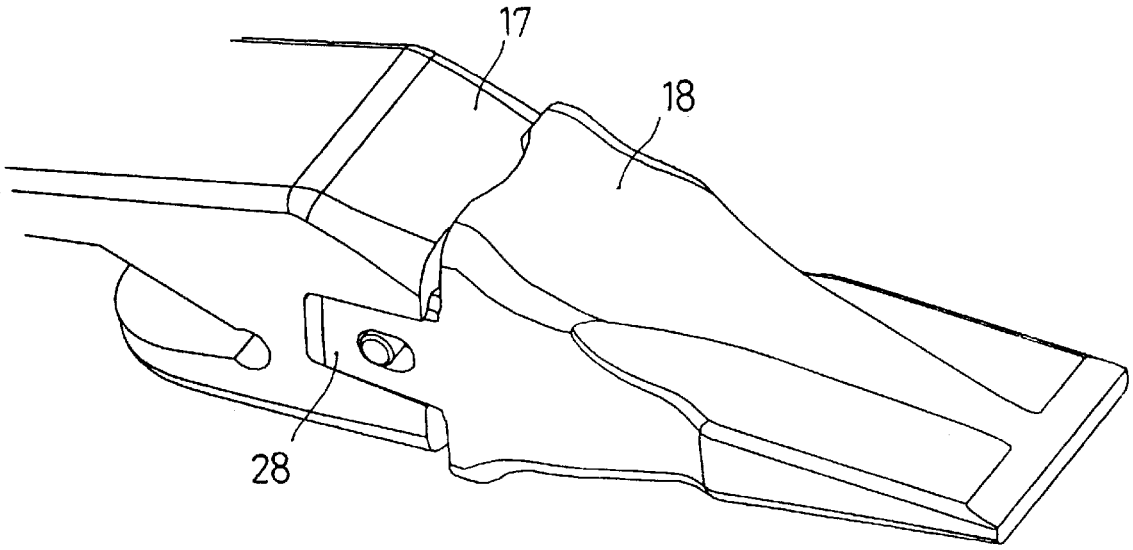
FIG. 6 shows a perspective view equivalent to FIG. 5, showing the tooth and the tooth holder in the mounted position.
Figure 7:
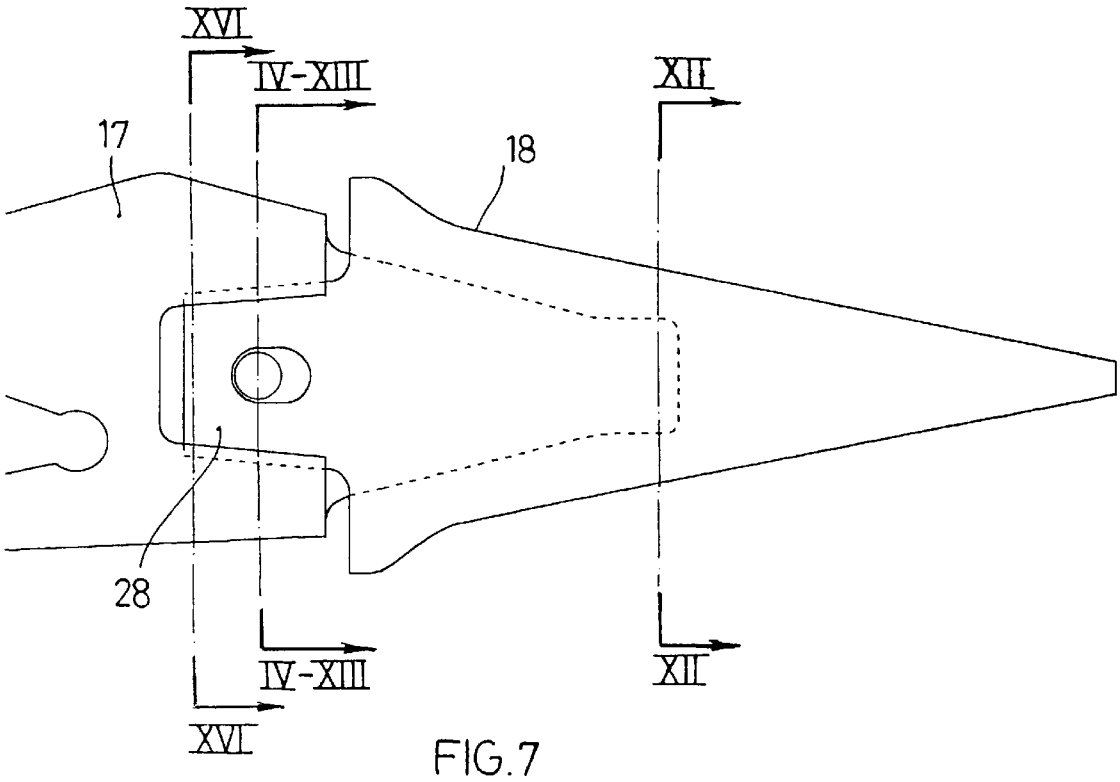
FIG. 7 shows a view in side elevation corresponding to FIG. 6.

Another of the characteristics of the coupling is likewise revealed in FIG. 5 and in the detail in section of FIG. 13, it being noted that the lugs 28 and 29 have upper and lower edges, for example 30 and 31 for the lug 28, which have a curved transverse section, preferably in the form of a sector of a circle, being coupled with surfaces of matched shape, that is to say, with the same curvature such as 32 and 33 corresponding to the upper part of the tooth holder. As can be seen in FIG. 13, both the flanges and the curved zones of matching shape of the tooth holder 17 have slight rebates which are substantially flat or provided with a very slight curvature in the outer zone, being shown by means of the numbers 34 and 35 for the upper edge of the lug 28.

By means of the arrangement shown, the result obtained is that the lugs cannot execute lateral movements towards the outside or the inside, so that they withstand correctly the stresses due to stabilization.

Another of the characteristics of the present invention will be seen in FIG. 14 compared with FIG. 3, in which a section corresponding to the prior art is shown. As can be seen in FIG. 3, the vertical rear edges 38 and 39 of the lateral lugs 4 and 4' simply have a reduced radius, so that the pressure which is produced between the said edges and the receiving surfaces of the tooth holder is very high, being the source of a high degree of wear. The solution adopted in the present invention is that shown in FIG. 14, in which the lateral lugs 36 and 37 both have on their rear edges chamfers 40 and 41 which face flat surfaces with the same angle of inclination, such as the surface indicated in the lower part of FIG. 14 by the number 42. In this way, when a lateral force occurs, represented by the vector 43, the tooth 44 tends to rotate on the point of contact 45, exerting its stress on the chamfer 41 and corresponding flat surface of the tooth holder, representing a more reduced surface pressure and, therefore, reduced wear. In the detail of FIG. 15 is shown the chamfer 41 of the flank 37 and the inclined flat surface 46 on which the said chamfer acts, representing a surface of considerable amplitude and therefore a reduced pressure.

FIG. 16 shows an alternative version of the lateral lugs, which are shown by the numbers 47 and 48, the smoothly curved structure of the principal bearing surface with the tooth holder 49 being seen. This gives rise to the arched coupling zones which are indicated by the numbers 50 and 51. In this case, the shape of the upper and lower edges of the said flanks and the corresponding grooves of the tooth holder could adopt a structure different from the curved one indicated previously as a preferred form, it being possible to adopt a mixed structure through the joining of straight and curved zones or with the joining of curved zones of different curvatures or of irregular curvatures, in all cases fulfilling the function of absorbing the lateral stresses.

As will be understood, by means of the provision of the tooth coupling for excavators according to the present invention, much more reliable working conditions can be obtained by achieving a longer life for the said couplings and moreover obtaining an effective indication of the state of wear which makes it possible to exchange the tooth holder in time, thus avoiding breakages.

I claim:

1. A coupling joint for the teeth of excavating machines, the coupling joint including a tooth and a tooth holder, the tooth holder including a projecting portion intended to fit into a cavity of the tooth and the coupling joint further including corresponding facing surfaces between the tooth and the tooth holder, the coupling joint comprising:

the tooth holder including upper and lower surfaces which define stabilization planes of the projecting portion, the upper and lower surfaces including a substantially flat central surface and two flat lateral surfaces, one on each side of the central surface, wherein the central surface and lateral surfaces are oriented so that the gap between the central surface and the corresponding facing surface of the tooth is smaller than the respective gaps between the lateral surfaces and the corresponding facing surfaces of the tooth;

the tooth including two lateral lugs extending from the rear edge of the tooth, for a predetermined length, the lateral lugs adapted to fit into corresponding lateral seatings of the tooth holder corresponding facing surfaces; and the lateral lugs including upper and lower edges and internal vertical edges, each of the upper and lower edges including a convex transverse structure corresponding to an equivalent structure of the facing surface of the tooth holder and each internal vertical edge including a flat surface of equivalent structure to the corresponding facing surface of the tooth holder, wherein said convex transverse structure on said upper and lower edges have a constant radius along said predetermined length.

2. The coupling joint for excavating machines according to claim 1, wherein the convex transverse section of the upper and lower edges of the lateral lugs comprising an arched transverse shape.

3. The coupling joint for excavating machines according to claim 1, wherein the convex transverse section of the upper and lower edges of the lateral lugs comprising a mixed section based on straight zones and arched zones.

4. The coupling joint for excavating machines according to claim 1, wherein the flat surface of the internal vertical edges of the lateral lugs and the corresponding facing surfaces of the tooth holder include the same angle of inclination.

5. The coupling joint for excavating machines according to claim 4, wherein the flat surface comprises a chamfer.

6. A coupling joint for the teeth of excavating machines, the coupling joint including a tooth and a tooth holder, the tooth holder including a projecting portion intended to fit into a cavity of the tooth and the coupling joint further including corresponding facing surfaces between the tooth and the tooth holder, the coupling joint comprising:

the tooth holder including upper and lower surfaces which define stabilization planes of the projecting portion, the upper and lower surfaces including a substantially flat central surface and two flat lateral surfaces, one on each side of the central surface, wherein the central surface and lateral surfaces are oriented so that the gap between the central surface and the corresponding facing surface of the tooth is smaller than the respective gaps between the lateral surfaces and the corresponding facing surfaces of the tooth;

the tooth including two lateral lugs extending from the rear edge of the tooth for a predetermined length, the lateral lugs adapted to fit into corresponding lateral seatings of the tooth holder corresponding facing surfaces; and the lateral lugs including upper and lower edges, each of the upper and lower edges including a convex transverse structure corresponding to an equivalent structure of the facing surface of the tooth holder, wherein said convex transverse structure on said upper and lower edges have a constant radius along said predetermined length.

7. A tooth for use in an excavating machine, the tooth coupled with a tooth holder to form corresponding facing surfaces between the tooth and the tooth holder and the tooth including, the tooth comprising:

two lateral lugs extending from the rear edge of the tooth for a predetermined length, the lateral lugs adapted to fit into corresponding lateral seatings of the tooth holder corresponding facing surfaces; and the lateral lugs including upper and lower edges and internal vertical edges, each of the upper and lower edges including a convex transverse structure adapted to correspond to an equivalent structure of the facing surface of the tooth holder and each internal vertical edge including a flat surface of equivalent structure adopted to correspond to the facing surface of the tooth holder, wherein said convex transverse structure on said upper and lower edges have a constant radius along said predetermined length.

* * * * *